United States Patent [19]

Osaki

[11] 4,118,158

[45] Oct. 3, 1978

[54] ROTARY PISTON COMPRESSOR

[76] Inventor: Toshio Osaki, 21-8, Momofune-cho, Nakagawa-ku, Nagoya-shi, Aichi-ken, Japan

[21] Appl. No.: 752,750

[22] Filed: Dec. 21, 1976

[30] Foreign Application Priority Data

Dec. 30, 1975 [JP] Japan ..... 50-156236

[51] Int. Cl.[2] ..... F04C 1/02

[52] U.S. Cl. ..... 418/54

[58] Field of Search ..... 418/54, 58, 182

[56] References Cited

U.S. PATENT DOCUMENTS

| | | | |
|---|---|---|---|
| 298,952 | 5/1884 | Donkin | 418/58 |
| 823,607 | 6/1906 | MacDonald | 418/122 X |
| 3,029,741 | 4/1962 | Frager et al. | 418/54 |
| 3,367,239 | 2/1968 | Takagi | 418/54 |
| 3,909,163 | 9/1975 | Huf | 418/61 B |

*Primary Examiner*—Carlton R. Croyle
*Assistant Examiner*—Leonard E. Smith
*Attorney, Agent, or Firm*—Armstrong, Nikaido, Marmelstein & Kubovcik

[57] ABSTRACT

A rotary piston compressor utilizing a cylindrical housing which encloses a rotary piston pump mechanism comprising an oval rotary piston which is disposed at an intermediate position between the shaft on one side of an Oldham's coupling mechanism and another offset shaft. An intake, compression and discharge action of fluid occur due to variation of volume between the rotary piston and the inner circumference of the cylinder due to eccentric rotation of the rotary piston.

2 Claims, 11 Drawing Figures

ROTARY PISTON COMPRESSOR

BACKGROUND OF THE INVENTION

1. Field of the Invention

The present invention relates to a rotary piston compressor intended for compressing fluids by means of a rotary piston.

More specifically, in a rotary piston pump [Japanese Pat. No. 821,174 (Publication Number 50-35246)] previously developed by the present applicant, a rotary piston compressor using a rotary piston pump and comprising a rotary piston with an approximately oval section is disclosed with Oldham's coupling mechanism disposed inside the cylinder so as to slide along the inside surface. An intake and a discharge for fluid are disposed on either side of the cylinder along a straight line connecting the central point of the eccentric shaft to take advantage of small and large clearance between the rotary piston and the internal circumferential surface of the cylinder due to eccentric rotation of the driving shaft and an off-set shaft, and is characterized in that one side of the shaft of Oldham's coupling mechanism is the drive shaft. An oval rotary piston is disposed in an intermediate position between the driving shaft and the other off-set shaft (called a correcting shaft hereinafter). This rotary piston is disposed to slide along the inside surface of the fixed cylinder, thereby taking advantage of variation of volume between the inside of the cylinder and outside of the rotary piston due to eccentric rotation of the rotary piston thereby forcing intake, compression and discharge of fluid.

2. Description of the Prior Art

Conventional reciprocating piston type compressors are unable to increase velocity due to inertia of the piston system because the piston has to change direction at the top or bottom dead point, so that it has been difficult to design higher speed and miniaturized versions of the compressor. Further, compression occurs at the stage of shifting the piston to the top dead point and only one full compression occurs for each cycle, thereby decreasing the efficiency.

In such rotary piston devices as the Wankel mechanism, the application of pressure to the receiving axis of pressure of the rotary piston acts repeatedly in the same direction so that abrasion in the sliding portion of the rotary piston is great and rotary balance of the rotary piston itself is liable to deteriorate.

SUMMARY OF THE INVENTION

The principal object of the present invention is to provide a rotary piston compressor which avoids the above-noted deficiencies of prior art devices.

Another object of the present invention is to provide a rotary piston compressor which minimizes loss of rotating energy, inertia and rotating vibration by achieving two-stroke compression for each rotation of the rotary piston.

A further object of the present invention is to provide a rotary piston compressor of improved durability and smoothness of operation and with reduced wear due to abrasion.

Other objects of the present invention will be clear from the following description.

DETAILED DESCRIPTION OF THE INVENTION

The structure of the present invention will be described with reference to the accompanying drawings.

Figure 1:
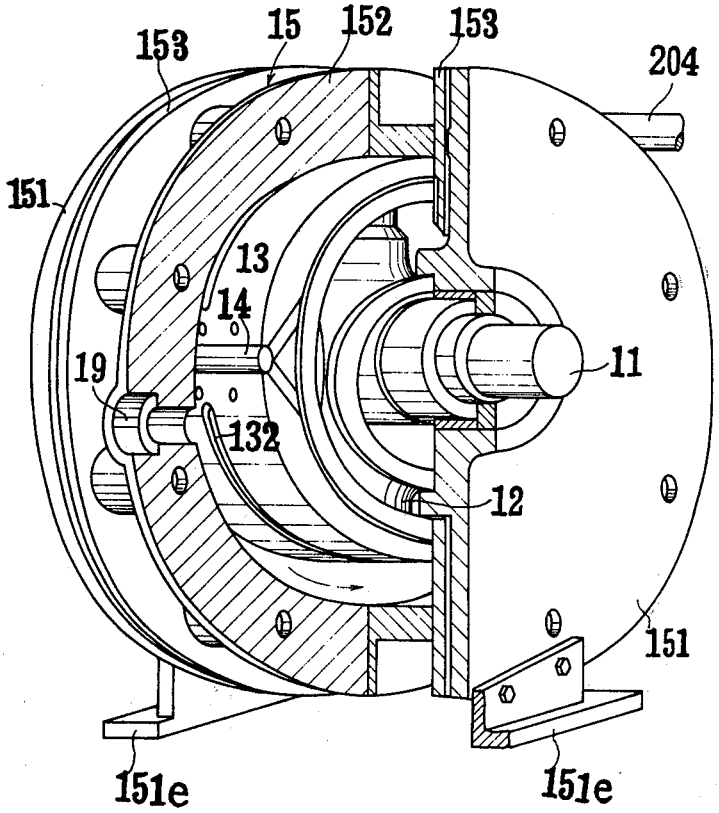
FIG. 1 is a perspective view showing a cross-section of the rotary piston compressor of the present invention in order to reveal the inside construction.
Figure 4:
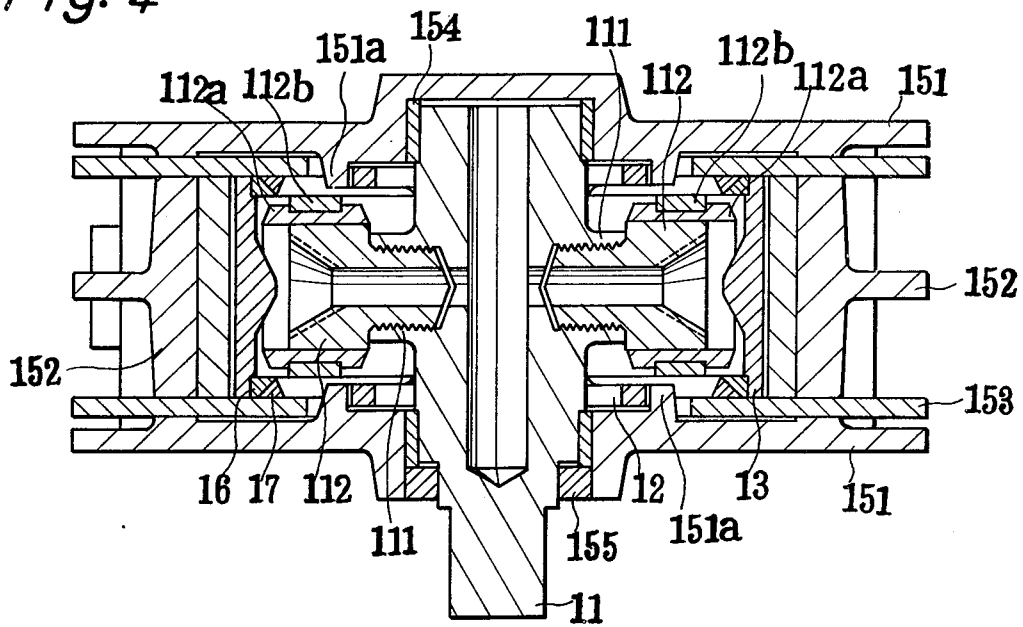
FIG. 4 is a section indicated by arrows through IV to IV in FIG. 2.
Figure 5A:
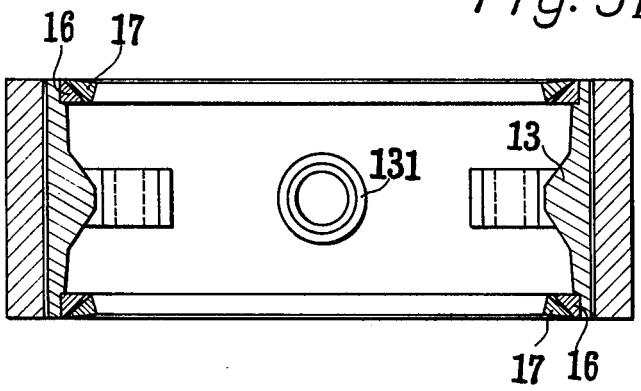
FIG. 5 is an enlarged illustration of the air-tight portion of the rotary piston and FIG. 5A is a section of the elevation of the rotary piston, FIG. 5B an illustration showing the construction in detail of the roller seal and the auxiliary seal and in FIG. 5C the rotary piston, in which the upper portion is a plane section and the lower portion is a plane view.
Figure 5B:
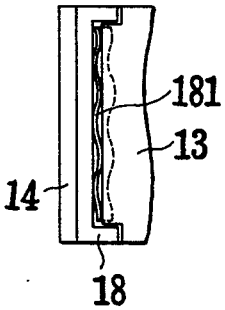
Figure 5C:
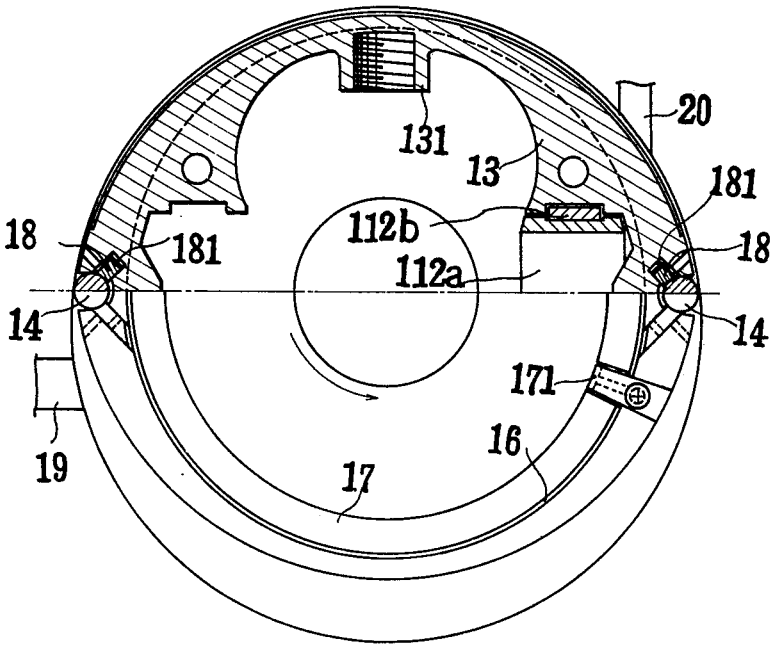

With reference to FIG. 1, 11 is a drive shaft one end of which projects outside cylinder 15. As shown in FIG. 4, a projection 111 is opposedly formed on the external circumference of the drive shaft 11. The external circumferential surface of the projection 111 is provided with a recessed portion having a female thread into which is screwed a sliding member 112 with male thread provided with a pass through nozzle in its central portion. Numeral 12 is a correcting shaft of cross-sectional form being disposed inside the cylinder 15 to cover said driving shaft 11 and the sliding member 111. Sliding member acceptor 121*a* opposedly projects vertically to the driving shaft 11. On the outside of the correcting shaft 12, a rotary piston 13 of oval section is disposed whose inside is hollow. On the internal circumferential surface of the rotary piston 13, the sliding member acceptor 112*a* is secured on a receiving member 112*b* at the position opposed to sliding portion 112 and secured by screwing onto said driving shaft 11. At the position opposed to sliding member acceptor of correcting shaft 12, a projection 131 is formed with a female screw on the internal circumference. The sliding member 121 of female screw form is provided with a pass-through nozzle on the central portion and is secured by screwing onto the projection 131. The rotary piston 13 is fitted into the external circumference of the sliding member 112, with the sliding member acceptor 112*a* secured onto the driving shaft 11 by screwing. The sliding member 121 is secured by screwing onto the projection 131 and is inserted into the sliding member acceptor 121*a* so as to eccentrically rotate around the driving shaft 11.

The sliding member acceptor 112*a* fitted into the sliding member 112 is secured on the driving shaft 11 and the sliding member acceptor 121*a* is fitted onto the sliding member 121 and secured on projection 131 of the internal circumferential surface of the rotary piston 13 which are vertically disposed to form an Oldham's coupling mechanism. On the external circumferential surface of the rotary piston 13, a groove 132 is disposed for improving the flow of fluid; and on the external circumference of rotary piston 13 and the extension of said sliding portion 112, a roller seal 14 of cylindrical form is provided for keeping air-tight the circumferential surface of the rotary piston 13, a seal ring 16 and a spring seal 17 are provided for keeping an air-tight seal. Numeral 171 is a pin for securing spring seal 17 onto the rotary piston 13. On both sides of the roller seal 14 an auxiliary seal 18 is provided and between the auxiliary seal 18 and the rotary piston 13, a plate spring 181 of corrugated form is provided.

Figure 3:
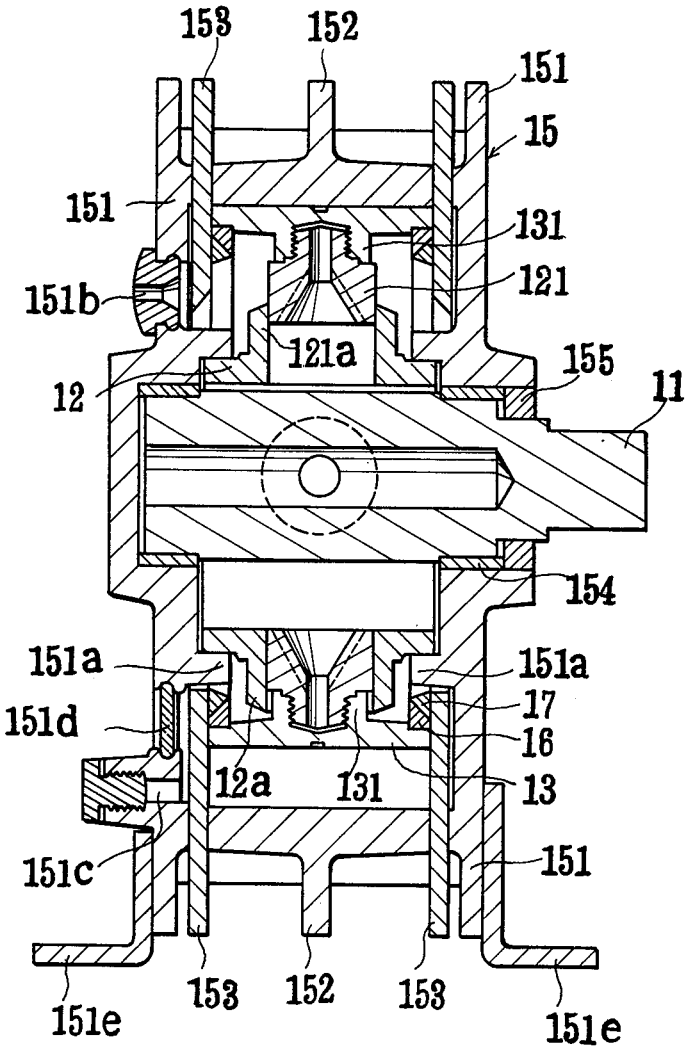
FIG. 3 is a section indicated by arrows through III to III in FIG. 2.

Outside of the rotary piston 13, a cylinder 15 comprising a side surface 151 of the cylinder, a circumferential surface 152 of the cylinder and a liner 153 on the side of the cylinder is provided so as to accommodate the rotary piston 13 therein. The cylinder 15 is formed by screwing bolts and the like to hold the liner 153 on the side of the cylinder with the side surface 151 and the circumferential surface 152 of the cylinder. The roller seal 14 which is provided on the external circumferential surface of the rotary piston 13 rotates on the circumferential surface 152 of the cylinder and drives the rotary piston 13. The liner 153 on the side of the cylinder is in close contact with the seal ring 16 and the spring seal 17 on both ends surfaces of the rotary piston 13. As shown in FIG. 3, inside the side surface 151 of the cylinder, an oval projection **151*a* is formed eccentric to the driving shaft 11, on which both ends of the correcting shaft 12 are rotatably supported. Between the side surface 151 of the cylinder and the driving shaft 11, a shaft stool 154 is provided and onto the projecting side of the driving shaft 11, a sealing member 155** is fitted.

Figure 2:
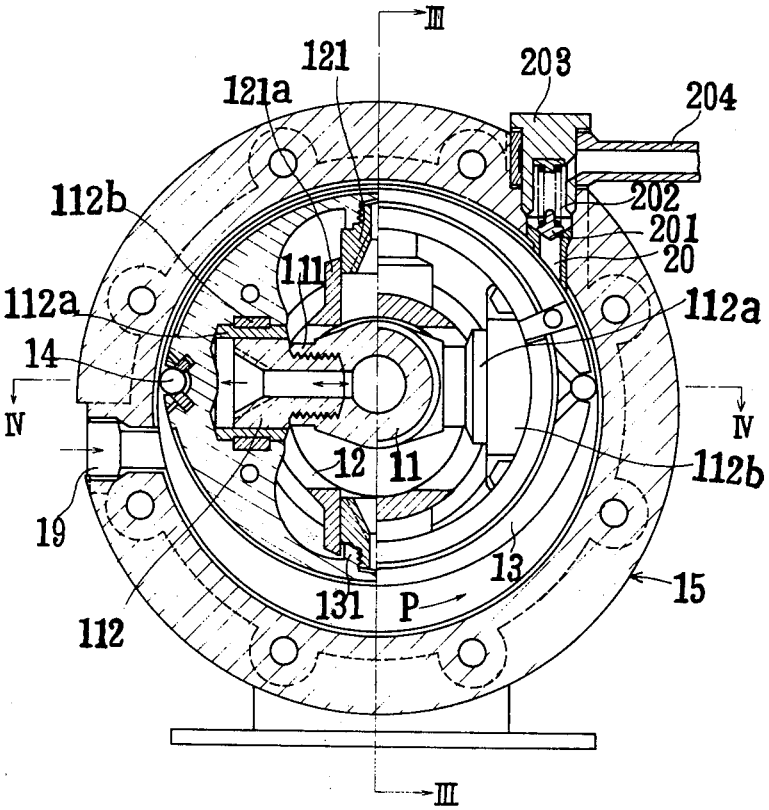
FIG. 2 is a section of the elevation of FIG. 1, in which the left side shows a section of the rotary piston and the right side a section of the drive shaft and the correcting shaft in the surface portion of the rotary piston.

As shown in FIG. 2, on the left side of the cylinder 15 an intake means 19 for fluid is disposed and on the right shoulder portion, a fluid discharge means 20 is provided, on which is formed a compressive fluid discharge valve comprising an automatic valve 201, a coil spring 202 and a valve bolt 203. The discharge 20 is closed by means of the automatic valve 201 which is subjected to the pressure of the coil spring 202 and opened only when discharging the compressive fluid. Connected to the discharge 20, a pressure pipe 204 is provided.

As shown in FIG. 3, **151*b* is an intake for lubricating oil, 151*c* a discharge, 151*d* an observation window and 151*e*** fixed legs.

The difference in construction of the rotary piston compressor of the present invention, conventional Wankel mechanism and reciprocating mechanism is described below:

| | Present Invention | Wankel mechanism | Reciprocating mechanism |
|---|---|---|---|
| Frequency of piston | 1 | 1 | 1 |
| Action | 2 | 3 | 1 |
| Frequency of main shaft | 1 | 3 | 1 |
| Surface of axis inside piston subjected to direct pressure | 1 (2) | 3 | 1 |
| Number of axis subjected to direct pressure | 2 | 2 | 3 |
| Radial thrusting rotation | Yes | Yes | 50–50 |

The present invention functions as follows. The rotary piston 13 is driven in the same manner as a rotary piston pump and rotates eccentrically inside the cylinder 15 to form a compression chamber P of crescent form, as shown in FIG. 6, between the external circumferential surface of the rotary piston 13 and the internal circumferential surface of the cylinder 15. With rotation of the rotary piston 13, the fluid admitted from the intake 19 is compressed within the compression chamber P and discharged through the discharge means 20.

By rotating the driving shaft 11, torque is transmitted to sliding member acceptor **112*a* of the rotary piston 13 through the sliding member 112, thereby providing rotational power to the rotary piston 13, a sliding member 121 is provided intersecting with said sliding member 112 of said driving shaft 11 at right angles, so that rotational power of the rotary piston 13 is also transmitted to the correcting shaft 12 through the sliding member 121. The sliding member acceptor 121*a* and the sliding member acceptor 121*a* of the correcting shaft are disposed intersecting with each other at right angles thereby forming Oldham's coupling mechanism. In FIG. 2, the sliding portion of the driving shaft 11 moves the sliding member acceptor 112*a* of the rotary piston 13 right and left, and the sliding member 121 of the rotary piston 13 moves the sliding portion acceptor 121*a* of the correcting shaft 12 vertically. The driving shaft 11, the correcting shaft 12 and the rotary piston 13 rotate together and allow the rotary piston 13 to rotate eccentrically with respect to the internal circumferential surface of the cylinder 15**.

As example of the intake, compression and discharge action of fluid is shown in FIG. 6.

Figure 6A:
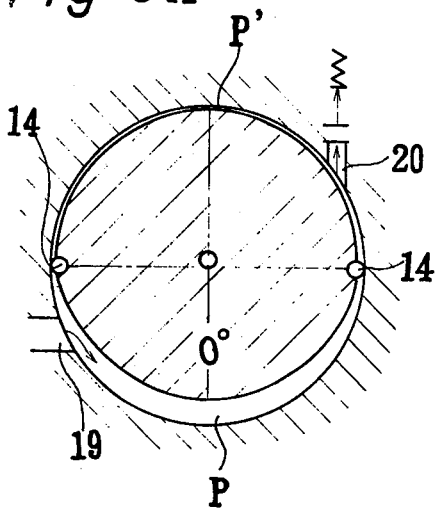
FIGS. 6A, B, C and D are illustrations showing the operation of the rotary piston.

FIG. 6A illustrates the case where the rotary piston 13 is in a phase of zero or 180°, in which fluid is admitted into the compression chamber P from the intake 19 in the direction of the arrow. Further, as shown in FIG. 6B (position in which the rotary piston 13 rotates 70°) and FIG. 6C (position in which the rotary piston rotates 90°), rotating the rotary piston 13, fluid admitted into the compression chamber P is compressed between the rotary piston 13 and the internal circumferential surface of the cylinder 15. This time, between the rotary piston 13 and the cylinder 15, two compression chambers P and P′ are formed and since the compression chambers P and P′ are kept air-tight with each other, when the roller seal 14 shown on the left of FIG. 6A reaches a position lower than the intake 19 (e.g., position shown in FIG. 6B) with the rotation of the rotary piston 13, fluid is likewise admitted into the compression chamber P′.

Figure 6D:
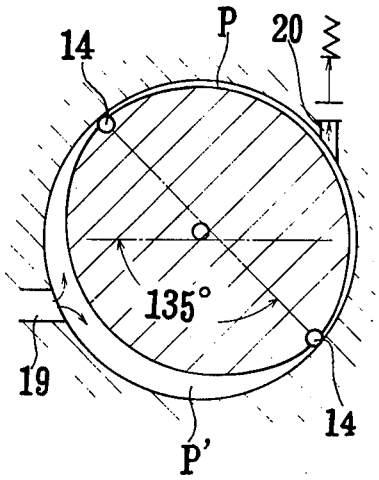
Figure 6B:
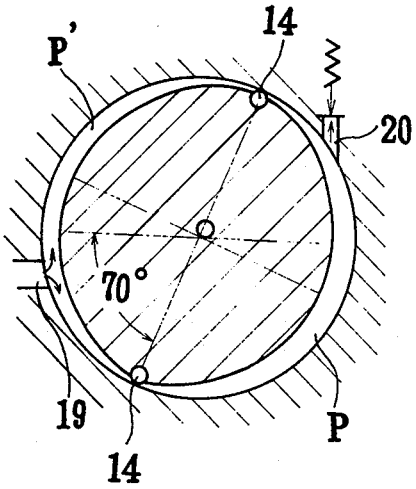
Figure 6C:
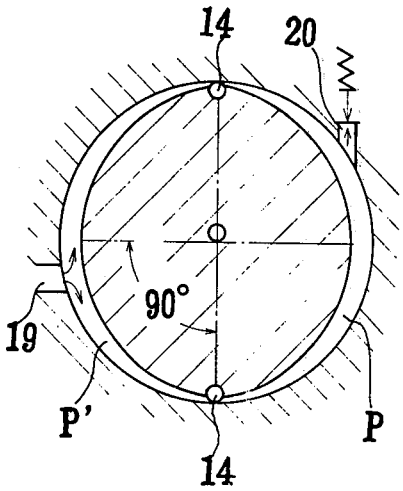

Then, with further rotation of the rotary piston 13 when the 135° position is reached as shown in FIG. 6D, the discharge 20 is opened and the compressed fluid is discharged outside.

Thus, for one rotation of the rotary piston 13, intake, compression and discharge actions take place twice, respectively. And, the intake 19 always functions only as an intake so that no valve is required on the intake side.

An example of variation in cross sectional area of the compression chamber P with the rotation of the rotary piston is described below:

| Rotary angle of rotary piston | 0 | 10 | 20 | 30 | 40 | 50 | 60 | 70 | 80 | 90 |
|---|---|---|---|---|---|---|---|---|---|---|
| Sectional area ($cm^2$) | 46 | 45 | 44 | 42 | 40 | 37 | 34 | 30 | 26 | 23 |

-continued

| Rotary angle | 100 | 110 | 120 | 130 | 140 | 150 | 160 | 170 | 180 |
|---|---|---|---|---|---|---|---|---|---|
| Sectional area ($cm^2$) | 19 | 15 | 12 | 8 | 6 | 4 | 2 | 1 | 0 |

Since the present invention is constructed as aforementioned, the compressor is minimized and the force of inertia is small. Thus, rotary vibration and noise are small. For each rotation of the rotary piston, two-cycle compression takes place, so that the rotary energy expanded is small and efficient and only a discharge valve on one side is needed.

In conventional units such as the Wankel mechanism, application of pressure to the axis of the rotary piston is repeated in the same direction every time, whereas in the present invention since the sliding portion 112 is divided into two portions as shown in FIG. 2 and the acting point of pressure is opposedly subject to pressure, abrasion of the sliding portion 112 is minimized. Moreover, since the present invention is provided with sliding portion 112 and sliding portion 121 at right angles thereto, rotary balance of the rotary piston itself is improved, thus contributing to greater durability. Further, the present invention is applicable to a vacuum pump.

What is claimed is:

1. A rotary piston compressor comprising (a) a cylinder;

(b) a drive shaft having a portion within said cylinder, both ends of said portion being supported on bearings;

(c) a rotary piston positioned within said cylinder;

(d) a correcting shaft surrounding a portion of said drive shaft both ends of said correcting shaft being supported by bearings;

(e) a pair of projection means positioned on opposite sides of the circumference of said drive shaft;

(f) a pair of first slide means each of said first slide means being positioned in one of said projection means;

(g) a pair of first slide acceptor means each first slide acceptor means slidably engaging one of said first slide means and secured to the interior circumferential surface of said rotary piston;

(h) a pair of second slide acceptor means, each second slide acceptor means being formed on said correcting shaft;

(i) a pair of second slide means, each second slide means being slidably engaged by one of said second slide acceptor means and secured to the interior circumferential surface of said rotary piston;

(j) seal means for forming fluid tight seals between said rotary piston and said cylinder;

(k) fluid intake means positioned on one side of the circumference of said cylinder; and (l) fluid discharge means positioned on an opposite side of the circumference of said cylinder said discharge means including a discharge valve.

2. A rotary piston compressor as set forth in claim 1 wherein said seal means comprises a cylindrical roll seal mounted in said rotary piston said seal making contact with the surface of said cylinder.

* * * * *